US005867891A

United States Patent [19]

Lampe, Jr. et al.

[11] Patent Number: 5,867,891

[45] Date of Patent: Feb. 9, 1999

[54] CONTINUOUS METHOD OF MANUFACTURING WIRE WOUND INDUCTORS AND WIRE WOUND INDUCTORS THEREBY

[75] Inventors: Ross Warren Lampe, Jr., Raleigh; Gerard James Hayes, Wake Forest, both of N.C.

[73] Assignee: Ericsson Inc., Research Triangle Park, N.C.

[21] Appl. No.: 775,195

[22] Filed: Dec. 30, 1996

[51] Int. Cl.[6] ..... H01F 7/06

[52] U.S. Cl. ..... 29/605

[58] Field of Search ..... 29/605, 602.1, 29/606, 608; 336/233, 83, 192, 198

[56] References Cited

U.S. PATENT DOCUMENTS

| | | | |
|---|---|---|---|
| 2,298,275 | 10/1942 | Bohren | 336/192 |
| 3,196,523 | 7/1965 | Bell | 29/605 |
| 3,259,862 | 7/1966 | Richard | 336/136 |
| 3,323,200 | 6/1967 | McKeon | 29/605 |
| 3,367,816 | 2/1968 | Mills | 29/605 |
| 3,609,833 | 10/1971 | Fry | 29/605 |
| 3,659,336 | 5/1972 | Horne | 29/605 |
| 3,670,406 | 6/1972 | Weber | 29/602.1 |
| 3,684,993 | 8/1972 | Hazen, III et al. | 336/136 |
| 3,689,981 | 9/1972 | La Valle | 29/605 |
| 3,811,045 | 5/1974 | Turner | 29/605 |
| 4,516,103 | 5/1985 | Arnold | 336/65 |
| 4,621,251 | 11/1986 | Keefe | 336/302 |
| 4,696,100 | 9/1987 | Yamamoto | 29/605 |
| 4,785,527 | 11/1988 | Bernard | 29/605 |
| 5,191,701 | 3/1993 | Espenhain | 29/605 |
| 5,262,745 | 11/1993 | Gutierrez | 336/192 |
| 5,351,167 | 9/1994 | Wai et al. | 336/760 |
| 5,572,788 | 11/1996 | Saitoh | 29/605 |
| 5,692,290 | 12/1997 | Mamada | 29/605 |

FOREIGN PATENT DOCUMENTS

| | | | |
|---|---|---|---|
| 20 55 285 A | 5/1972 | Germany . | |
| 24 50 513 A | 4/1976 | Germany . | |
| 30 42 433.0 | 7/1982 | Germany . | |
| 2-271511 | 11/1990 | Japan | 29/605 |
| 2-290006 | 11/1990 | Japan | 29/605 |

OTHER PUBLICATIONS

Patent Abstracts of Japan, vol. 007, No. 065 (E–165), 18 Mar. 1983 & JP 57 211712 A (Matsushita Denki Sangyo KK), 25 Dec. 1982, see abstract.

Patent Abstracts of Japan, vol. 007, No. 170 (E–189), 27 Jul. 1983 & JP 58 075825 A (Murata Seisakusho:KK), 7 May 1983, see abstract.

ATT Technologies, *Technical Digest*, No. 76, Mar. 1985, F. T. Dickens and R. A. Frantz, Jr., pp. 19 and 20.

*Primary Examiner*—Daniel B. Moon
*Assistant Examiner*—James P. Calve
*Attorney, Agent, or Firm*—Nixon & Vanderhye PC

[57] ABSTRACT

A wire-wound inductor includes a dielectric core, terminals including wire staples that are crimped around the core, and a wire winding disposed about the perimeter of the core and connected to the terminals. A coating such as an adhesive coating is disposed over the wire winding and between the terminals. The process for manufacturing the inductors in a continuous process. Beginning with a spooled material, which may be extruded, inductors are formed on a core material sequentially. The inductors are not physically separated until the final stages of manufacturing, which is in contrast to the prior art method in which each inductor is individually constructed on an individual core that has been manufactured with tight tolerances and wound individually. By virtue of the characteristics of the inductor components, extremely tight tolerances (typically about 0.0005") can be obtained, resulting in highly controlled inductance values.

28 Claims, 2 Drawing Sheets

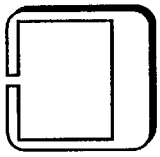
FIG. 8
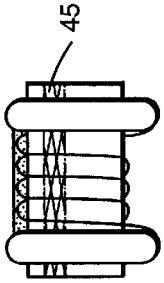
FIG. 9
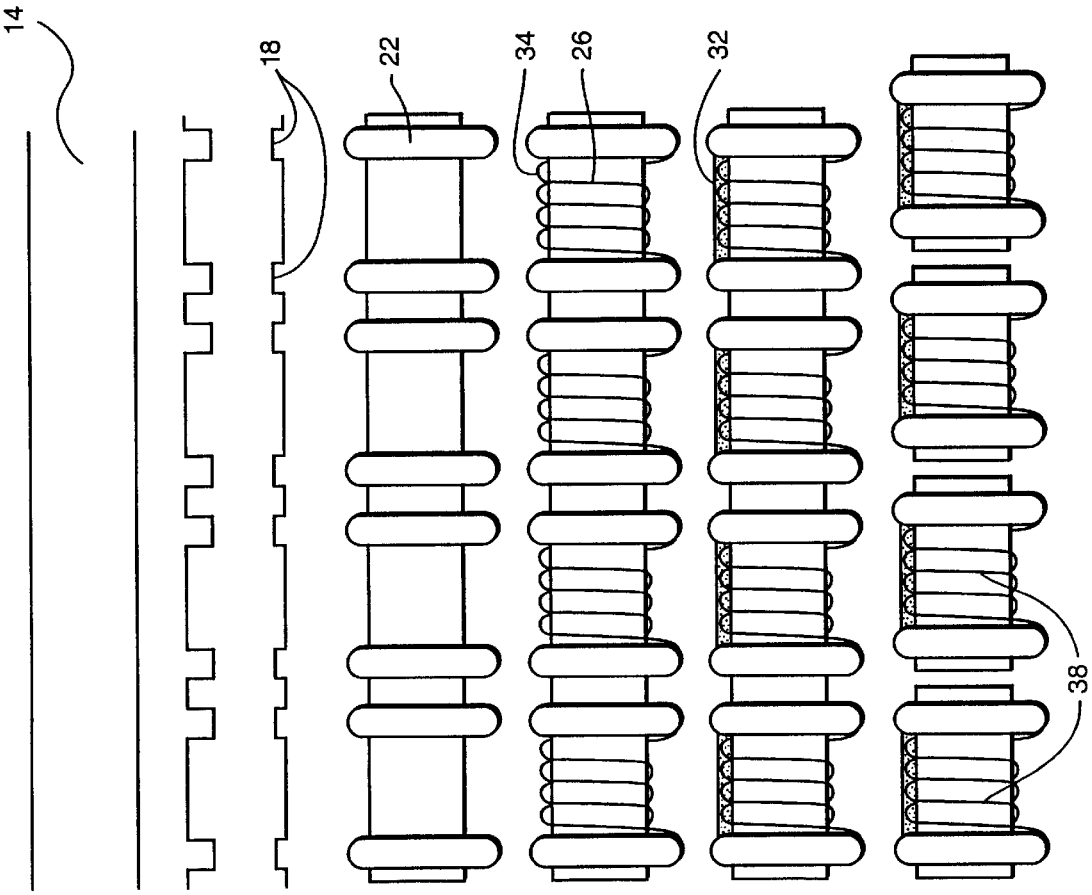
FIG. 2
FIG. 3
FIG. 4
FIG. 5
FIG. 6
FIG. 7

CONTINUOUS METHOD OF MANUFACTURING WIRE WOUND INDUCTORS AND WIRE WOUND INDUCTORS THEREBY

BACKGROUND OF THE INVENTION

The present invention relates to a method for manufacturing a wire wound inductor and, in particular, to a continuous method of manufacturing wire wound inductors utilizing an extruded core material along with simplified terminal attachment and wire winding processes in order to reduce inductor manufacturing costs.

Inductors form an integral component of radio frequency (RF) circuits. As a group, inductors form about ⅓ of the basic building blocks for circuit design.

The basic form of inductors is a wire coil. The coil can be free-standing (air-core) or wrapped around a core. Other versions of inductors (such as multi-layer or printed design) are known; however, superior performance is achieved from a coil. With the advent of surface-mount technologies for high-speed manufacturing of printed circuit boards, the size of inductors has greatly decreased. Surface-mounted, wire-wound inductors are currently available in industry standard 0805 and 0603 size packages. These inductors consist of a molded core material (either a thermoset plastic or a ceramic) with wire windings and plated terminals.

The electrical measurement unit for inductance is Henries. To the first order approximation, the inductance value of a wire coil is $L=(4\pi N^2A/W)\times10^{-9}$ Henries, where N is the number of turns in the coil, A is the cross sectional area of the coil, and W is the length of the coil. All three variables (N, A, and W) are independent such that they can be independently varied to obtain a desired inductance value L.

Inductors are currently manufactured one at a time with the wire ends of the windings being bonded while the inductor is in the winding fixture. This method is time consuming, resulting in increased manufacturing costs and can result in less than desirable tolerance deviations. In addition, conventional inductors utilize core materials that cannot be extruded in large quantities and thus cannot take advantage of a continuous process. Moreover, the conventional core materials are difficult to machine, and as a result, the cross sectional area of the coil can be difficult to determine accurately. Still further, terminals in the conventional inductors are coplanar (i.e., on the same side of the inductor), and the wire windings begin and terminate on the same side (typically the bottom) of the device. As a result, only integer multiples of windings are possible (N in the above equation for Henries). In turn, this limits the number of inductance values (L in the above equation) obtainable for a given core size. Still further, an adhesive coating (particularly a UV or heat cured plastic) is added to wire wound surface-mountable inductors in order to secure the wire windings and to provide a smooth, uniform surface for automated placement devices. Since the coating material can run over the edges of the device, an external mold may be required to provide a uniform surface.

SUMMARY OF THE INVENTION

It is an object of the invention to provide an inductor and a method of manufacturing inductors that overcome the drawbacks associated with the prior art. It is a further object of the invention to provide an inductor that utilizes materials that are conducive to manufacturing and that reduce manufacturing costs.

In an exemplary embodiment according to the invention, there is provided a method of manufacturing inductors that includes the steps of (a) extruding a length of core material, (b) forming and crimping wire staple terminals around the core material, and (c) wrapping wire windings around the core material between the wire staple terminals and connecting the wire windings to the wire staple terminals. Step (a) may be practiced by (d) extruding a thermoplastic material forming an arbitrary cross section and (e) feeding the extruded thermoplastic material into a core sizing station. After step (d), the method may include the step of coiling the extruded thermoplastic material into a coil and, prior to step (e), the step of uncoiling the coil. The core material may be machined to a desired cross section in accordance with a desired inductance. Notches are formed in the material, and step (b) is practiced by securing the wire staple terminals in the notches. Step (b) may be practiced by uncoiling a section of spooled wire, shearing the section, shaping the wire to fit around the core material, and crimping the wire around the core material thereby forming the inductor terminals. Step (c) may be practiced by connecting the wire windings to the wire staple terminals at selected locations about the perimeter of the core material in accordance with a desired inductance. Step (c) may be further practiced by (f) soldering the wire windings to the wire staple terminals. In this regard, step (f) is preferably practiced by heat and pressure staking or by welding. The method may still further include the step of (g) applying a coating material over the wire windings between the wire staple terminals. In this regard, step (g) is preferably practiced by coating a UV curable material over the wire windings between the wire staple terminals. The individual inductors, thus constructed, are separated from one another along the length of core material. Subsequently, the individual inductors are tested for electrical performance and sorted in accordance with a tolerance deviation.

In accordance with another aspect of the invention, there is provided a method of manufacturing inductors including the steps of (a) extruding a length of core material sufficient for a plurality of inductors, (b) forming and crimping wire staple terminals around the core material along the length of core material in locations corresponding to the plurality of inductors, and (c) wrapping wire windings around the core material between the wire staple terminals and connecting ends of the wire windings to pairs of the wire staple terminals corresponding to each of the plurality of inductors, respectively.

In another exemplary aspect of the invention, there is provided a method of manufacturing inductors that resides on a single manufacturing platform with a single positioning reference.

In accordance with still another aspect of the invention, there is provided an inductor including a dielectric core, which may be extruded, terminals including wire staples that are crimped around the core, and a wire winding disposed about the perimeter of the core and connected to the terminals. A coating such as an adhesive coating, for example, may be disposed over the wire winding and between the terminals. The wire staples preferably extend out from the dielectric core defining a well therebetween, wherein the coating is preferably disposed in the well between the wire staples. In one embodiment, a magnetic core is disposed inside of the dielectric core. The dielectric core is preferably formed of a thermoplastic material having a melting temperature above about 350° F. and preferably above about 650° F. The dielectric core may include notches formed in the perimeter thereof for receiving the wire staples. The wire staples are preferably formed from a spool material, which preferably comprises tin-copper. The wire staples may further extend out from a PCB side of the dielectric core. The wire windings may be secured at selected locations about the perimeter of the core in accordance with a desired inductance.

In accordance with yet another aspect of the invention, there is provided an inductor including a dielectric core, a pair of terminals attached to the core, and a wire winding disposed about the perimeter of the core and connected to the terminals. The wire winding includes a selected plurality of turns including partial turns around the core in accordance with a desired inductance.

BRIEF DESCRIPTION OF THE DRAWINGS

These and other aspects and advantages of the present invention will be described in detail with reference to the accompanying drawings, in which:

FIG. 2 illustrates the extruded core after passing through the core sizing station;

FIG. 3 illustrates the core after passing through the core notching station;

FIG. 4 shows the core with the wire staple terminals attached;

FIG. 5 illustrates the core with the wire staple terminals and the wire windings;

FIG. 6 illustrates the inductors after passing through the inductor coating station;

FIG. 7 illustrates the separated inductors ready for testing and sorting;

FIG. 8 is an end view of the inductor according to the invention; and

FIG. 9 illustrates an alternative embodiment inductor according to the present invention.

DETAILED DESCRIPTION OF PREFERRED EMBODIMENTS

Figure 1:
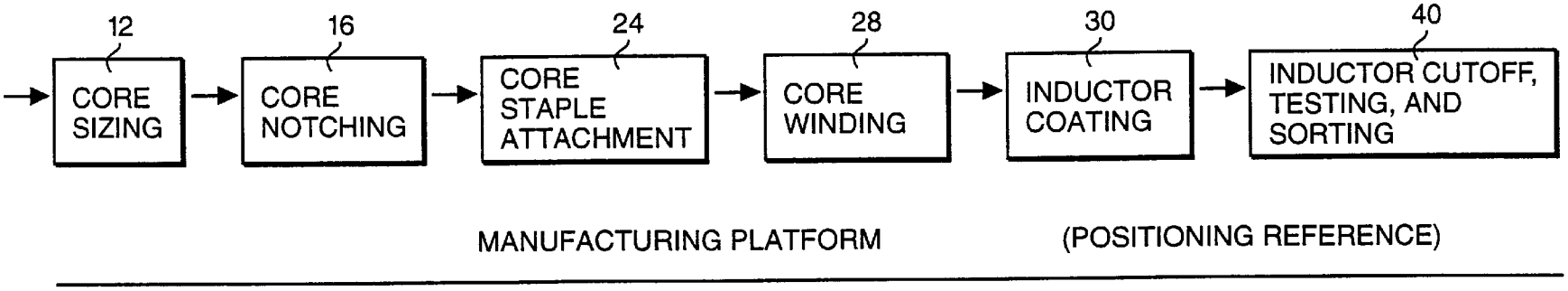
FIG. 1 is a station diagram for the method according to the present invention.

The structural components of the inductor according to the present invention will be described in conjunction with the method of manufacturing the inductors. FIG. 1 is a station diagram for the method according to the invention. With reference to FIGS. 2–7, an extruded core material, as shown in FIG. 2, with an arbitrary cross section (preferably rectangular) is fed into a core sizing station 12. The extruding process is well known and will not be further described. Initially, a core material such as a high temperature thermoplastic is extruded a length sufficient for a plurality of inductors. A high temperature thermoplastic is a thermoplastic having a melting temperature above about 350° F. A preferred material with respect to the present structure is a thermoplastic material having a melting temperature above about 650° F. Examples of such materials include TEFLON, PEEK and PEK. In contrast with the prior art ceramic core material or thermoset plastic core material, the thermoplastic core material can be extruded in large quantities and in a continuous process. In addition, the core material is readily machined for sizing and notching (described below). Any variation of the cross sectional area, the variable A in the above equation, corresponds directly to a variation in inductance value, the variable L in the above equation. Consequently, the core material can be machined to a desired cross section with extreme accuracy in accordance with a known machining process. Typically, the core material is machined to within a +/−0.0005" accuracy. A segment of machined core material is labeled 14 in FIG. 2.

At the core notching station 16, notches 18 are formed in the core material where the device terminals are to be placed. The notches 18 may be formed in any suitable manner, and are preferably formed with a solid carbide saw or a high speed steel saw. The notches 18 are formed on all sides of the core material in order to accommodate the device terminals, which are crimped around the device. Depending on the diameter of the terminal material and the desired profile of the inductor, the depth of each notch can be set and controlled with extreme accuracy. For example, a deeper notch is preferred on the top and sides of the inductor to minimize the inductor profile. The notch on the bottom, conversely, can be made more shallow so that the height of the inductor above a printed circuit board can be controlled. A side view of a completed inductor illustrating the inductor profile is shown in FIG. 8. A segment of machined and notched core material is illustrated in FIG. 3.

Next, the inductor terminals 22 are added in the core staple attachment station 24. The inductor terminals 22 consist of wire staples that are formed from a coiled material and crimped around the core material at the notches 18. The staples are formed from spooled wire, such as 28 AWG tin-copper stock. In a single motion, the wire is sheared at an appropriate length, shaped to fit around the core using a first U-shaped tool, and crimped around the core using a second tool to form the device terminals. The second tool bends the U-shaped wire around the bottom of the core. A segment of core material having the wire staple terminals attached is shown in FIG. 4.

Next, as shown in FIG. 5, the inductor windings 26 are added at a core winding station 28 by wrapping a fine gauge wire (typically 44 AWG) around the core material. The windings 26 are secured to the wire staple terminals 22 by any suitable method such as heat and pressure staking, extremely high temperature soldering, and welding. In the heat and pressure staking method, the windings 26 are heated and pressed against the wire staple terminal at any desired location. The windings 26 include a polyurethane insulator. When attaching the wire windings 26 to the wire staple terminals, the heat and pressure melts the polyurethane insulator and melts the tin of the wire staple. The melted tin flows around the inductor wire, thereby soldering the wire winding in place. Since the tin coating on the wire staple terminals create the bonding between the winding wire and the terminal staples, additional materials (such as solder) are not required. The wire staple terminals 22 are stapled around the core material, and thus, the wire windings 26 can be secured virtually anywhere along the perimeter of the inductor. As a result, the number of windings for the inductor can be finely controlled (including partial turns around the core), which enables the realization of intermediate inductance values for a given core size.

Referring to FIG. 6, the inductors are next passed through an inductor coating station 30 where a coating material 32 is dispensed between the two wire staple terminals 22 at the top of each inductor. In addition to securing the inductor windings 26, the coating material 32 forms a smooth, flat surface that is well suited for automatic placement machines currently used in electrical circuit board assembly. Any suitable means of dispensing the coating material 32 could be used, and several such means are well-known. The details of the dispensing means will therefore not be further described. Typically, the coating material 32 is a UV curable material such as solder mask or dielectric coatings or one of various epoxies. The wire staple terminals 22 are spaced slightly above the top surface of the core to define a well 34 between the terminals. As a result of the well 34 defined by the terminals 22, an external mold is not required to form a uniform surface area for automated placement machines as is typically required with conventional inductors.

The individual inductors 38 are separated from one another at the inductor cut-off, testing and sorting station 40. The inductors are mechanically sawed between the inductor terminals with sufficient room to allow for the kerf of the saw. In an alternative configuration, the inductors can be separated using a known laser trimming process. Once an inductor has been separated, it is placed on a testing platform where it is tested for electrical performance using, for example, an impedance analyzer. Depending on the measured inductance value, each inductor is then sorted into bins according to a tolerance deviation from desired. Each bin can subsequently be placed into a standardized tape and reel machine for packaging.

The process according to the invention is a continuous process. Beginning with a spooled extruded material, inductors are formed on a core material sequentially. The inductors are not physically separated until the final stages of manufacturing (specifically for testing and sorting). This is in sharp contrast to the current method in which each inductor is individually constructed on an individual core that has been manufactured with tight tolerances and wound individually. The continuous process according to the invention establishes greater yields over a discrete process. Moreover, extruding the core material is a less expensive process as compared to molding that is used with thermoset plastics and ceramics.

By virtue of the extruded material, the process can maintain extremely tight tolerances (typically about 0.0005"), which is unprecedented in wire-wound inductor manufacturing. The ability to maintain such a high precision on the cross-sectional area results in highly controlled inductance values. The sizing process can be isolated from the inductor manufacturing process, and spool-to-spool machining operation can be performed at high speeds on the core material. Consequently, production volumes can be greatly enhanced.

The wire winding process is also a continuous process with the spooled wire being rotated around the core material. This is in contrast to the prior method in which the individual inductors are rotated in a bobbin-like manner. Since the winding in the process according to the invention is continuous, manufacturing variations due to starting and stopping motions can be avoided. Moreover, less set up time is needed, and more inductors can be wound in a given time interval.

In addition to being part of the continuous process, the notching of the core material and forming staples out of spooled, standard tinned wire stock is an important feature of the invention. Previously, after each core material was machined, the terminal leads had to be formed in a secondary process (typically by plating with a high-temperature solder paste). In addition to requiring an added manufacturing step, the previous method required additional material treatment (such as heating to a high temperature and depositing the solder paste). Thus, since additional manufacturing steps are not required in the present method, manufacturing platforms are less costly. Moreover, standard readily available materials are used instead of more complex materials that require special handling. Still further, the staple making process flattens the bottom of the wire stock, thus making it a better surface for soldering.

As shown in FIG. 1, the entire process can reside on a single manufacturing platform with a single positioning reference. Consequently, the input materials to each stage of the process do not have to be realigned. Instead, the entire stage (including notching, stapling, winding and cutting) is aligned to a single positioning reference. The prior method included several isolated manufacturing stages. As a result, each part needed to be carefully realigned in order to avoid large manufacturing deviations that may affect performance. As a result of the single manufacturing platform, a tighter manufacturing tolerance can be maintained that results in better yields. Moreover, since additional positioning devices for realignment are not required, manufacturing platforms are less costly. In similar regard, since the addition of a coating material is integrated into the manufacturing process, additional manufacturing steps are not required, and manufacturing platforms are less costly.

To further enhance performance capabilities, referring to FIG. 9, the core can be extruded around a center conductor 45 to provide a magnetic core. Alternatively, the extrusion can have a slot in which a magnetic core can be later pressed.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims.

What is claimed is:

1. A method of manufacturing inductors comprising:

(a) extruding a length of core material;

(b) subsequently forming and crimping wire staple terminals around the core material from a bendable wire material; and (c) wrapping wire windings around the core material between the wire staple terminals and connecting the wire windings to the wire staple terminals.

2. A method according to claim 1, wherein step (a) is practiced by (d) extruding a thermoplastic material forming an arbitrary cross section and (e) feeding the extruded thermoplastic material into a core sizing station.

3. A method according to claim 2, further comprising, after step (e) and continuous with steps (a)–(d), the step of machining the core material to a desired cross section in accordance with a desired inductance.

4. A method according to claim 1, further comprising, prior to step (b), the step of forming notches in the core material, wherein step (b) is practiced by securing the wire staple terminals in the notches.

5. A method according to claim 1, wherein step (b) is practiced by uncoiling a section of spooled wire, shearing the section, shaping the wire to fit around the core material, and crimping the wire around the core material, thereby forming the inductor terminals.

6. A method according to claim 1, wherein step (c) is practiced by connecting the wire windings to the wire staple terminals at selected locations about the perimeter of the core material in accordance with a desired inductance.

7. A method according to claim 1, wherein step (c) is practiced by (f) soldering the wire windings to the wire staple terminals.

8. A method according to claim 7, wherein step (f) is practiced by heat and pressure staking.

9. A method according to claim 7, wherein step (f) is practiced by welding.

10. A method according to claim 1, further comprising (g) applying a coating material over the wire windings between the wire staple terminals.

11. A method according to claim 10, wherein step (g) is practiced by coating a UV curable material over the wire windings between the wire staple terminals.

12. A method according to claim 10, further comprising separating individual inductors from one another along the length of core material.

13. A method according to claim 12, further comprising testing the individual inductors for electrical performance and sorting the individual inductors in accordance with a tolerance deviation.

14. A method according to claim 1, further comprising separating individual inductors from one another along the length of core material.

15. A method according to claim 14, further comprising testing the individual inductors for electrical performance and sorting the individual inductors in accordance with a tolerance deviation.

16. A method of manufacturing inductors comprising:

(a) extruding a length of core material sufficient for a plurality of inductors;

(b) subsequently forming and crimping wire staple terminals from a bendable wire material around the core material along the length of core material in locations corresponding to the plurality of inductors; and (c) wrapping wire windings around the core material between the wire staple terminals and connecting ends of the wire windings to pairs of the wire staple terminals corresponding to each of the plurality of inductors, respectively.

17. A method according to claim 16, wherein step (a) is practiced by (d) extruding a thermoplastic material forming an arbitrary cross section and (e) feeding the extruded thermoplastic material into a core sizing station.

18. A method according to claim 17, further comprising, after step (e) and continuous with steps (a)–(d), the step of machining the core material to a desired cross section in accordance with a desired inductance.

19. A method according to claim 16, further comprising, prior to step (b), the step of forming notches in the core material, wherein step (b) is practiced by securing the wire staple terminals in the notches.

20. A method according to claim 16, wherein step (b) is practiced by uncoiling a section of spooled wire, shearing the section, shaping the wire to fit around the core material, and crimping the wire around the core material, thereby forming the inductor terminals.

21. A method according to claim 16, wherein step (c) is practiced by connecting the wire windings to the wire staple terminals at selected locations about the perimeter of the core material in accordance with a desired inductance.

22. A method according to claim 16, wherein step (c) is practiced by (f) soldering the wire windings to the wire staple terminals.

23. A method according to claim 22, wherein step (f) is practiced by heat and pressure staking.

24. A method according to claim 22, wherein step (f) is practiced by welding.

25. A method according to claim 16, further comprising (g) applying a coating material over the wire windings between the wire staple terminals.

26. A method according to claim 25, wherein step (g) is practiced by coating a UV curable material over the wire windings between the wire staple terminals.

27. A method according to claim 16, further comprising separating individual inductors from one another along the length of core material.

28. A method according to claim 27, further comprising testing the individual inductors for electrical performance and sorting the individual inductors in accordance with a tolerance deviation.

* * * * *